US005340291A

United States Patent [19]

Benckert et al.

[11] Patent Number: 5,340,291

[45] Date of Patent: Aug. 23, 1994

[54] FLOW RESTRAINING DEVICE FOR A THICK MATTER CONVEYING APPARATUS

[75] Inventors: Hartmut Benckert, Filderstadt; Helmut Hurr, Reutlingen, both of Fed. Rep. of Germany

[73] Assignee: Putzmeister-Werk Maschinenfabrik GmbH, Aichtal, Fed. Rep. of Germany

[21] Appl. No.: 961,918

[22] PCT Filed: Feb. 16, 1991

[86] PCT No.: PCT/EP91/00304

§ 371 Date: Jan. 13, 1993

§ 102(e) Date: Jan. 13, 1993

[87] PCT Pub. No.: WO92/01158

PCT Pub. Date: Jan. 23, 1992

[30] Foreign Application Priority Data

Jul. 13, 1990 [DE] Fed. Rep. of Germany ..... 4022357

[51] Int. Cl.[5] ..... F04B 15/02; F04B 21/02

[52] U.S. Cl. ..... 417/569; 417/900; 137/515; 137/849; 251/212

[58] Field of Search ..... 417/569, 570, 900; 37/515, 515.7, 844, 849; 251/212

[56] References Cited

U.S. PATENT DOCUMENTS

| | | | |
|---|---|---|---|
| 2,897,835 | 8/1959 | Philippe | 137/849 |
| 3,058,430 | 10/1962 | Handl | 417/900 |
| 3,174,434 | 3/1965 | Schieve | 137/849 |
| 3,199,457 | 8/1965 | Smart | 137/849 |
| 3,749,521 | 7/1973 | Coone . | |
| 3,895,646 | 7/1975 | Howat | 137/849 |
| 4,067,540 | 1/1978 | Slade | 251/212 |
| 4,465,102 | 8/1984 | Rupp | 137/849 |

FOREIGN PATENT DOCUMENTS

| | | | |
|---|---|---|---|
| 510960 | 10/1930 | Fed. Rep. of Germany . | |
| 571874 | 3/1932 | Fed. Rep. of Germany . | |
| 818605 | 10/1951 | Fed. Rep. of Germany . | |
| 1816790 | 7/1970 | Fed. Rep. of Germany . | |
| 7210028 | 7/1973 | Fed. Rep. of Germany . | |
| 489760 | 4/1918 | France . | |
| 1301646 | 7/1962 | France | 137/849 |
| 515128 | 2/1955 | Italy | 137/849 |
| 216996 | 1/1985 | Netherlands | 137/849 |
| 693045 | 11/1979 | U.S.S.R. | 417/900 |

*Primary Examiner*—Richard A. Bertsch
*Assistant Examiner*—Roland G. McAndrews, Jr.
*Attorney, Agent, or Firm*—Kenyon & Kenyon

[57] ABSTRACT

An apparatus for conveying thick matter is provided including a delivery line, a thick matter pump connected to the delivery line for conveying thick matter from the pump through the delivery line in an output direction, and a restraining member positioned in the delivery line. The restraining member includes a first group of finger lamellae that are radially arranged and have openings therebetween. Each of the finger lamellae of the first group includes an end secured on the inner surface of the delivery line and an unattached end extending diagonally in the output direction and toward the inside of the delivery line. The finger lamella thereby define a pass-through opening therein for enabling flow of thick matter through the restraining member such that the pass-through opening increases in size when thick matter flows in the output direction and decreases in size when there is no flow of thick matter or when thick matter moves in a direction opposite to the output direction. The restraining member also includes a second group of finger lamellae which have openings therebetween and are arranged relative to the finger lamellae of the first group such that the finger lamellae of the second group at least partially cover the openings between the finger lamellae of the first group.

20 Claims, 3 Drawing Sheets

FLOW RESTRAINING DEVICE FOR A THICK MATTER CONVEYING APPARATUS

BACKGROUND OF THE INVENTION

An apparatus for conveying thick matter, mud, and bulk material of that kind, comprising a thick matter pump, which works preferably with an oscillating motion, a delivery line which is attached to the thick matter pump on the delivery side, and a restraining member, which is arranged in the delivery line and clears the passage, allowing the bulk material to pass through in the delivery line, and blocks it at least partially in the opposite direction.

In an already generally known apparatus of this type, a hydraulically actuated valve plate controlled by the piston travel is arranged at the outlet port of a thick matter pump designed as a single-piston pump. The valve plate releases the outlet port during the piston's pressure stroke and seals it during the suction stroke, so that the bulk material is prevented from flowing back. Apparatuses of this type require a relatively costly control system. Moreover, the service life of the valve plate is inadequate, because the abrasive bulk material subjects the moving slide parts to a considerable amount of wear.

The invention starts from here and is directed to improving the apparatus of the type indicated at the outset in a way that will allow the restraining member to work without controlling means and substantially free of wear.

SUMMARY OF THE INVENTION

The thought underlying the invention is that a restraining member having a pass-through opening, which expands elastically under the action of the bulk material flowing in the direction of output flow and which automatically narrows or contracts when the flow of the bulk material stops or when it is directed contrary to the direction of output flow, is hardly susceptible to wear and, moreover, makes do without a controlling means.

In the case of round delivery-line cross-sections, the pass-through opening of the restraining member is advantageously formed by a central opening and by several slit-type openings which extend from the central opening in a star shape or radial arrangement contrary to the direction of output flow up to the inner surface of the delivery line. On the other hand, in the case of rectangular delivery-line cross-sections, the pass-through opening of the restraining member can be made up of one gap-type opening and several slit-type openings, which extend essentially parallel from the gap-type opening, diagonally opposite the direction of output flow, up to the inner surface of the delivery line. While in the first case, the restraining member is effectively comprised of several spring-elastic finger lamellae, which are arranged at angular distances from one another in a star shape and form the boundary of the pass-through opening, and are inserted on one side in the area of the inner surface of the delivery line, and extend with their unattached ends diagonally in the direction of output flow toward the inside of the delivery line, in the case of rectangular delivery-line cross-sections, finger lamellae of the mentioned type are provided, which are preferably arranged at a lateral distance from one another and parallel to one another.

A preferred refinement of the invention provides that the unattached ends of the finger lamellae are able to bend up toward the inner wall of the delivery line under the action of the bulk material flowing in the direction of output flow, while widening the pass-through opening, and that the bent-up, unattached ends of the finger lamellae are able to bend back automatically into their blocking position when the flow of bulk material stops or is directed contrary to the direction of output flow, while narrowing the passthrough opening.

The finger lamellae expediently consist of a flat material of spring steel, which is concavely bent as viewed in the upstream side of the restraining member bent in the direction of output flow toward the =central opening, or of a spring-elastic plastic. One can avoid overlappings at the unattached ends, or rather too wide slit-type openings in the area of the inserted ends of the finger lamellae having a star-shaped configuration by providing finger lamellae that have an essentially wedge-shaped pattern.

An effective way to prevent the finger lamellae from becoming jammed or from rubbing against each other is to arrange them at a distance from one another, while leaving open narrow slit-type openings between their lateral boundary surfaces that face one another. The unattached, front-side ends of the stress-relieved finger lamellae can likewise be arranged at a distance from one another, while leaving open a small central opening.

The return flow of low-viscosity bulk material can be prevented or minimized when the restraining member has two groups of finger lamellae, which are arranged in the direction of output flow at a slight distance from one another, whereby in each case the finger lamellae in the one group advantageously cover, at least in part, the slit-type openings between the finger lamellae of the other group.

Alternatively, the finger lamellae which are adjacent to one another in the stress-relieved state can abut against each other with their lateral boundary surfaces that face each other, while sealing off the slit-type openings.

Another advantageous refinement of the invention then provides that at least two of the front-side ends of the stress-relieved finger lamellae abut against each other while completely sealing off the central opening.

The installation of the restraining member in the delivery line can be facilitated by securing the finger lamellae to the inside of a bearing ring, which is able to be inserted into the delivery line in the vicinity of a pipe coupling.

The bearing ring is able to be effectively inserted thereby in the axial direction between mutually opposing end faces of two pipe liners of the delivery line, which are able to be coupled together.

To prevent the bulk material from damming up at an inwardly projecting bearing ring or rather at the inserted ends of the finger lamellae, the delivery line can have an interior cross-section which is conically tapered in the direction of output flow, upstream from the bearing ring, and a stepped widening in the vicinity of the bearing ring.

While finger lamellae consisting of spring steel are expediently fastened with screws to a rigid bearing ring or vulcanized on to a bearing ring consisting of rubber elastic material, plastic finger lamellae can be integrally developed in one piece with a bearing ring which likewise consists of plastic.

BRIEF DESCRIPTION OF THE DRAWINGS

The invention will be clarified in greater detail in the following on the basis of two advantageous exemplified embodiments which are schematically depicted in the drawings. The FIGS. show.

DETAILED DESCRIPTION

Figure 4:
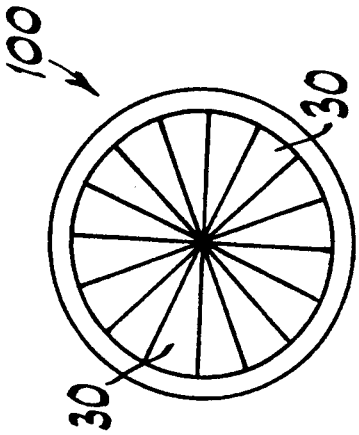

The delivery installation depicted in the drawing has a single-cylinder piston pump 14 and a delivery line 12, which is attached on the delivery side and contains a restraining member 10. The installation serves, above all, to deliver thick matter and mud.

The single-cylinder piston pump 14 consists essentially of a filler shaft 16, a feed cylinder 20, which projects on the front side over the filler shaft 16 and is coupled to this filler shaft by way of an intake port 18, as well as a delivery piston 24, which is able to move hydraulically on a stationary piston rod 22 between two end positions.

The restraining member 10 has a bearing ring 28, which is inserted into the delivery line 12 in the vicinity of a pipe coupling 26, and several spring-elastic finger lamellae 30. These finger lamellae are arranged at angular distances from one another in a star shape and move in to engage with the inside space of the delivery line 12, designed as a cylindrical pipe, and delimit the pass-through opening 32.

Figure 1:
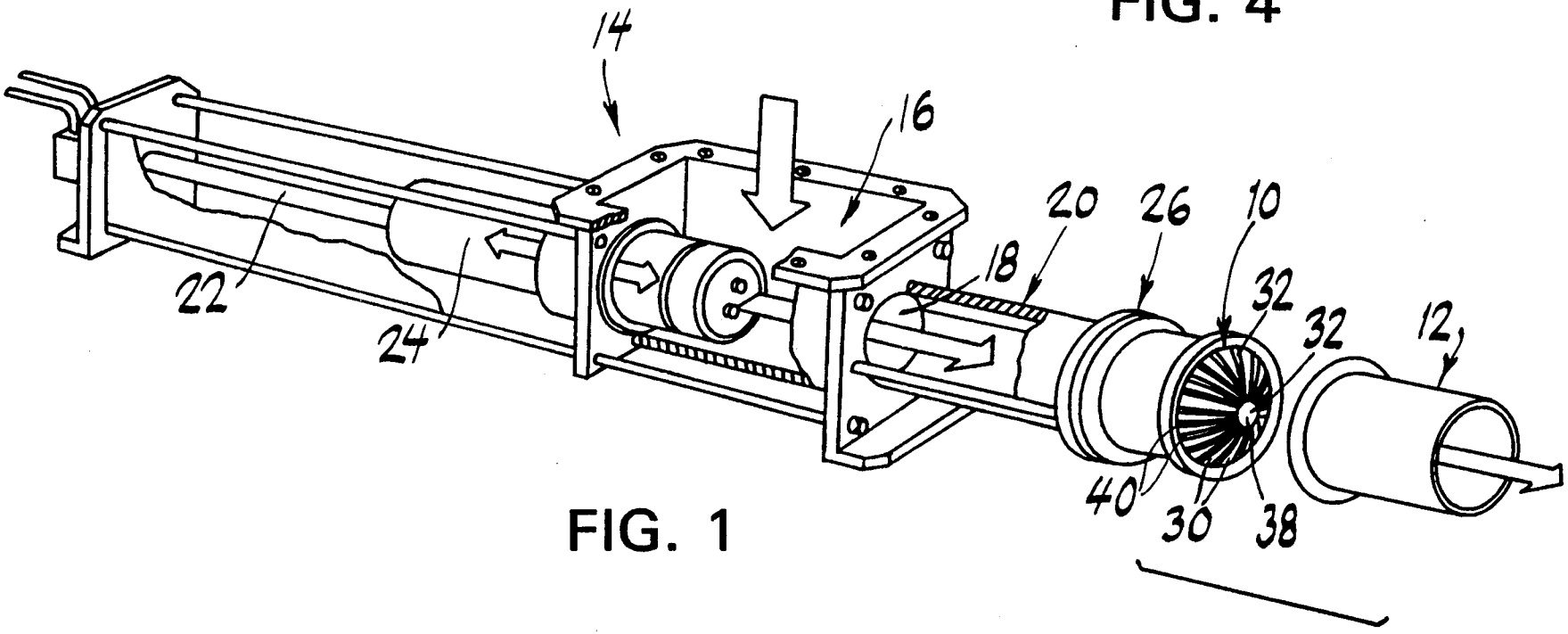
FIG. 1 is a schematic representation of a thick-matter delivery installation in a partially intersected perspective view.
Figure 2:
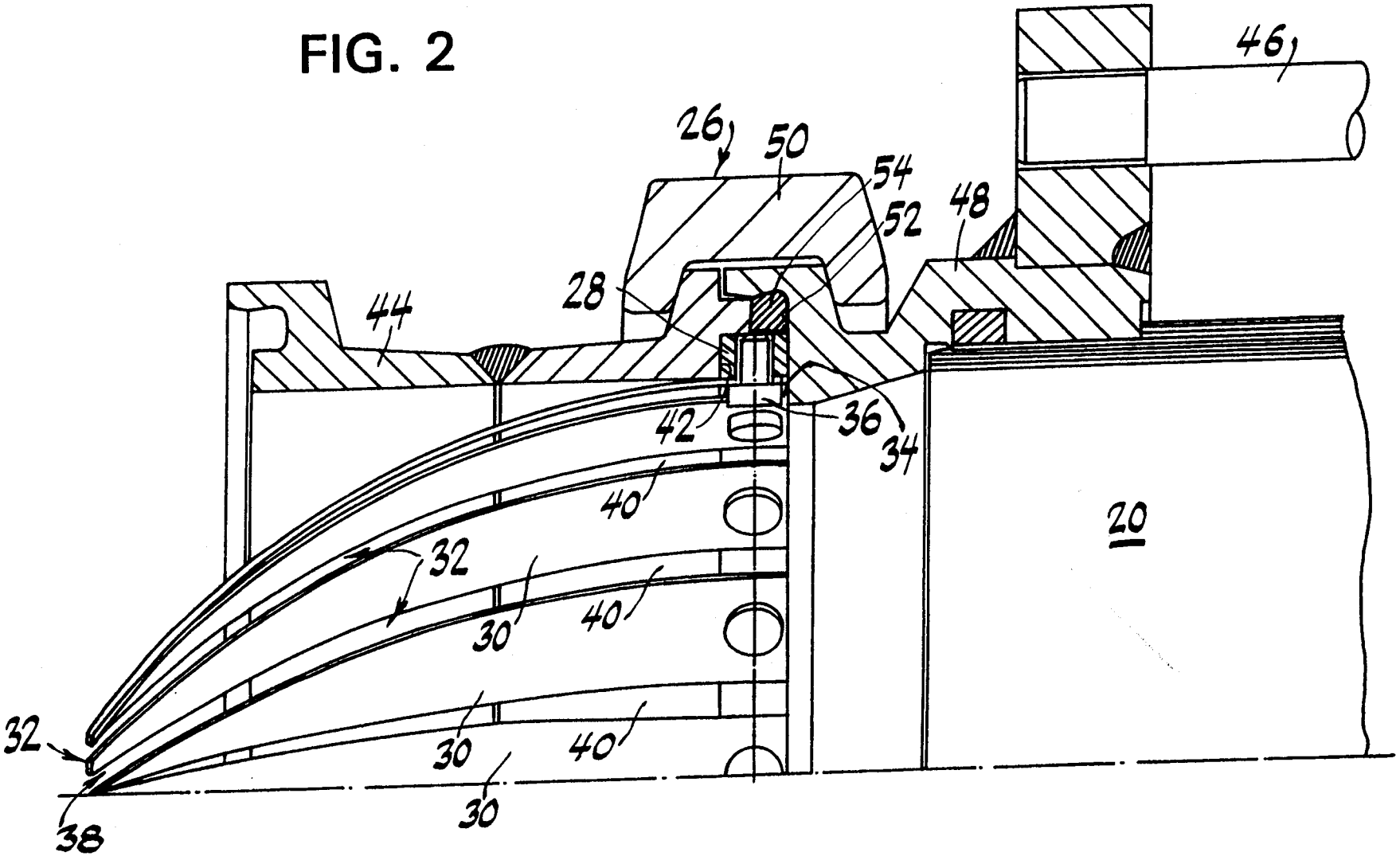
FIG. 2 is a longitudinal section through the restraining member of the delivery installation according to FIG. 1.

The finger lamellae 30 consist in each case of a spring-steel plate, which is essentially cut to size in a wedge shape and bent, and, at its wider end facing the single-cylinder piston pump 14, is fastened with retaining screws 36 to the bearing ring 28, so that it abuts against the inner peripheral area 34 of this bearing ring. When the finger lamellae are relieved of stress, the pass-through opening 32 is formed by a central opening 38 surrounded by the unattached ends of the finger lamellae 30, as well as by radially arranged slit-type openings 40, which are left open in each case between the mutually facing lateral boundary surfaces of two adjacent finger lamellae 30 (FIG. 1 and 2). The cross-section of the central opening 38 and the width of the slit-type openings 40 are selected so as to prevent the finger lamellae from becoming jammed on the one hand and, on the other hand, so as to hold back coarse material during the suction stroke of the piston pump, while plugging the pass-through opening 32.

In the vicinity of the restraining member 10, the delivery line 12 has a short pipe liner 44. This pipe liner 44 is provided with a front-side bore 42 and is able to be coupled to a mounting flange 48 that is secured in the area of the outlet port of the delivery cylinder 20 by means of an anchoring rod. The bearing ring 28 of the restraining member 10, which is inserted into the bore 42, is clamped between the mutually opposing end faces of the pipe liner 44 and of the mounting flange 48, when these end faces are pressed against each other in the axial direction when the half-shells 50 of the coupling 26 are coupled. The pipe coupling 26 is sealed by a sealing ring 54, which abuts on the periphery of the bearing ring 28 and is arranged in an annular gap 52 between the front ends of the pipe liner 44 and the mounting flange 48. Between the outlet port of the delivery cylinder 20 and its end face abutting on the bearing ring, the connecting flange 48 exhibits a conically tapered interior cross-section, so that the bulk material being pressed out of the delivery cylinder 20 cannot dam up at the heads of the retaining screws 36.

Figure 3:
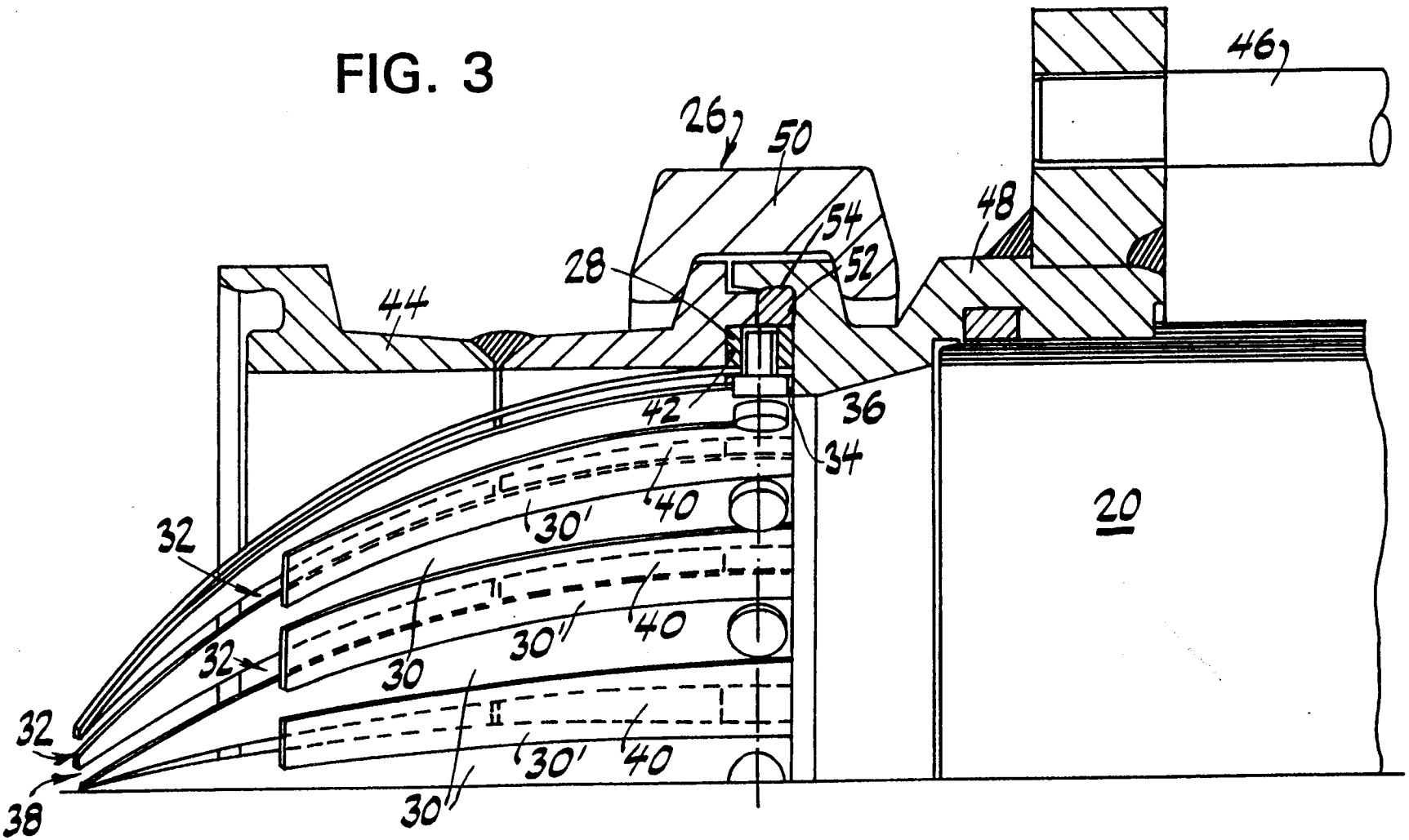
FIG. 3 a longitudinal section through another restraining member.

The restraining member 10 depicted in FIG. 3 exhibits two rows of finger lamellae 30 or 30', which are distributed over the circumference of the bearing ring 28. The finger lamellae 30', which abut from the inside of the pass-through opening 32 against the finger lamellae 30, seal off the slit-type openings 40 formed between the finger lamellae 30 in a predominant area, so that low-viscosity bulk material is also held back.

During the pressure stroke of the delivery piston 24 of the single-cylinder piston pump 14, the bulk material is pressed out of the filler shaft 16 into the delivery cylinder 20 and, from there, into the delivery line 12. The unattached ends of the finger lamellae 30 are bent apart by the bulk material as it is moved in the direction of output flow, while the pass-through opening 32 is elastically widened, so that they abut with prestressing on the inner surface of the pipe liner 44.

After reaching its front dead center, the delivery piston 24 is drawn back in its suction stroke up to the front end of the filler shaft 16 situated opposite the inlet port 18, whereby bulk material falls or flows out of the filler shaft 16 into the space that is becoming free, upstream from the front end of the delivery piston 24. The finger lamellae 30 of the restraining member 10 bend back thereby at the beginning of the suction stroke, because of the prestress they are subject to and also reinforced by the partial vacuum that develops while the delivery piston 24 is pulled back in the delivery cylinder 20 and/or by the hydrostatic pressure prevailing in the delivery line 12 into their neutral position depicted in FIG. 1 and 2. In this manner, they prevent bulk material from flowing back out of the delivery line 12 into the delivery cylinder 20. A restraining member 100 is shown in FIG. 4 in accordance with another embodiment of the invention wherein the unattached ends of the finger lamellae 30 abut each other when the restraining member is in an unstressed state to seal off the central opening.

We claim:

1. An apparatus for conveying thick matter, comprising:

a delivery line having an inner surface;

a thick matter pump connected to the delivery line for conveying thick matter from the pump through the delivery line in an output direction; and a restraining member positioned in the delivery line, said restraining member including a first group of finger lamellae wherein said finger lamellae are radially arranged with respect to a point within the delivery line and said lamellae have slit type openings therebetween, said finger lamellae of the first group each including an end secured on the inner surface of the delivery line and an unattached end extending diagonally in the output direction and toward the inside of the delivery line, said finger lamellae of the first group thereby defining a pass-through opening therein, wherein said pass-through opening increases in size when thick matter flows in the output direction and wherein said pass-through opening decreases in size when there is no flow of thick matter or when thick matter moves in a direction opposite to the output direction, said restraining member also including a second group of finger lamellae, said finger lamellae of said second group having slit type openings therebetween and being arranged relative to said lamellae of said first group such that the finger lamellae of one of said first and second groups at least partially cover the slit type openings between the finger lamellae of the other group.

2. The apparatus of claim 1, wherein said unattached ends of said finger lamella of the first group abut each other such that there is no central opening therebetween when said restraining member is in an unstressed state.

3. The apparatus of claim 1, further comprising a pipe coupling connected to said deliver pipe and a bearing ring wherein said finger lamella of the first and second groups are connected to said bearing ring and said bearing ring is positioned in said delivery line proximate said pipe coupling.

4. The apparatus of claim 1, further comprising a bearing ring wherein said finger lamella of the first and second groups are connected to said bearing ring, the apparatus further comprising a pair of pipe liners having mutually opposing end faces to be coupled together wherein said bearing ring is positioned between said end faces.

5. The apparatus of claim 1, wherein said unattached ends of said finger lamellae of the first group are spaced apart from each other, forming a central opening therebetween.

6. The apparatus of claim 5, wherein said finger lamellae of the first group bend concavely such that said unattached end move toward said central opening and in a direction opposite the output direction when thick matter moves in a direction opposite the output direction.

7. The apparatus of claim 1, further comprising a bearing ring positioned in said delivery line wherein said finger lamella of the first and second groups are connected to said bearing ring.

8. The apparatus of claim 7, wherein said delivery line includes an interior portion that is conically tapered in the output direction and is upstream of the bearing ring, said delivery line further including a stepped widened portion proximate said bearing ring.

9. The apparatus of claim 7, wherein said finger lamella comprise spring steel and wherein said finger lamella are fastened to said bearing ring with screws.

10. The apparatus of claim 7, wherein said bearing ring comprises an elastic material and wherein said finger lamella comprise spring steel and are vulcanized to the bearing ring.

11. An apparatus for conveying thick matter, comprising:

a delivery line having an inner surface;

a thick matter pump connected to the delivery line for conveying thick matter from the pump through the delivery line in an output direction; and a restraining member positioned in the delivery line, said restraining member including a first group of finger lamellae wherein said finger lamellae are radially arranged with respect to a point within the delivery line and said lamellae have openings therebetween, said finger lamellae of the first group each including an end secured on the inner surface of the delivery line and an unattached end extending diagonally in the output direction and toward the inside of the delivery line, said finger lamellae of the first group thereby defining a pass-through opening therein for enabling flow of thick matter therethrough wherein said pass-through opening increases in size when thick matter flows in the output direction and wherein said pass-through opening decreases in size when there is no flow of thick matter or when thick matter moves in a direction opposite to the output direction, said restraining member also including a second group of finger lamellae, said finger lamellae of said second group having openings therebetween and being arranged relative to said finger lamellae of said first group such that said finger lamellae of said second group at least partially cover the openings between the finger lamellae of said first group.

12. The apparatus of claim 11, wherein said unattached ends of said finger lamella of the first group abut each other such that there is no central opening therebetween when said restraining member is in an unstressed state.

13. The apparatus of claim 11, further comprising a pipe coupling connected to said delivery pipe and a bearing ring wherein said finger lamella of the first and second groups are connected to said bearing ring and said bearing ring is positioned in said delivery line proximate said pipe coupling.

14. The apparatus of claim 11, further comprising a bearing ring wherein said finger lamella of the first and second groups are connected to said bearing ring, the apparatus further comprising a pair of pipe liners having mutually opposing end faces to be coupled together wherein said bearing ring is positioned between said end faces.

15. The apparatus of claim 11, wherein said unattached ends of said finger lamellae of the first group are spaced apart from each other, forming a central opening therebetween.

16. The apparatus of claim 15, wherein said finger lamellae of the first group bend concavely such that said unattached ends move toward said central opening and in a direction opposite the output direction when thick matter moves in a direction opposite the output direction.

17. The apparatus of claim 11, further comprising a bearing ring positioned in said delivery line wherein said finger lamella of the first and second groups are connected to said bearing ring.

18. The apparatus of claim 17, wherein said delivery line has an interior portion that is conically tapered in the output direction and is upstream of the bearing ring, said delivery line further including a stepped widened portion proximate said bearing ring.

19. The apparatus of claim 17, wherein said finger lamella comprise spring steel and are fastened to said bearing ring with screws.

20. The apparatus of claim 17, wherein said bearing ring comprises an elastic material and wherein said finger lamella comprise spring steel and are vulcanized to the bearing ring.

* * * * *

UNITED STATES PATENT AND TRADEMARK OFFICE

CERTIFICATE OF CORRECTION

PATENT NO. : 5,340,291
DATED : August 23, 1994
INVENTOR(S) : Benckert et al.

It is certified that error appears in the above-indentified patent and that said Letters Patent is hereby corrected as shown below:

Column 2, line 13 delete "bent";

Column 2, line 14 delete "=";

Column 3, line 15 insert -- Fig. 4 is a front view of a restraining member in accordance with another embodiment of the invention. --;

Column 5, line 6 change "said" to -- said finger --;

Column 5, line 35 change "end" to -- ends --.

Signed and Sealed this

Fourteenth Day of March, 1995

Bruce Lehman

*Attest:*

BRUCE LEHMAN

*Attesting Officer*

*Commissioner of Patents and Trademarks*